United States Patent [19]

Beck

[11] 4,085,842

[45] Apr. 25, 1978

[54] GARMENT HANGER BOX

[75] Inventor: Robert E. Beck, Chicago, Ill.

[73] Assignee: Container Corporation of America, Chicago, Ill.

[21] Appl. No.: 757,926

[22] Filed: Jan. 10, 1977

[51] Int. Cl.[2] ..... B65D 85/18

[52] U.S. Cl. ..... 206/289; 206/300

[58] Field of Search ..... 206/284–291, 206/300; 229/34 H

[56] References Cited

U.S. PATENT DOCUMENTS

| | | | |
|---|---|---|---|
| 1,617,365 | 2/1927 | Batts | 206/291 |
| 1,626,381 | 4/1927 | Batts | 206/291 |
| 1,954,607 | 4/1934 | Wheary et al. | 206/289 |
| 1,958,230 | 5/1934 | Blechman | 206/289 |
| 3,057,460 | 10/1962 | Richer | 206/289 |
| 3,115,968 | 12/1963 | Peterson | 206/300 |
| 3,259,229 | 7/1966 | Brittingham | 206/289 |

*Primary Examiner*—Herbert F. Ross

*Attorney, Agent, or Firm*—Carpenter & Ostis

[57] ABSTRACT

A garment hanger box formed from a unitary sheet of foldable paperboard and comprising a pair of telescoping sections, one of which has a hollow top wall section with an enlarged portion forming a hanger hook receiving pocket.

1 Claim, 5 Drawing Figures

GARMENT HANGER BOX

SUMMARY OF THE INVENTION

This invention relates to garment boxes of the type used to hold and transport one or more garments carried on a hanger.

It is an object of the invention to provide a garment box of the type described which has a hollow top wall structure with an enlarged central area for receiving one or more garment hanger hooks.

A more specific object of the invention is the provision of a box formed of a paperboard blank and including a pair of telescoping sections, one of which has a top wall including a pair of upper and lower panels and a connecting panel which define a hollow structure that is wider in the center than at the ends, to provide a hanger hook receiving pocket.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

Figure 5:
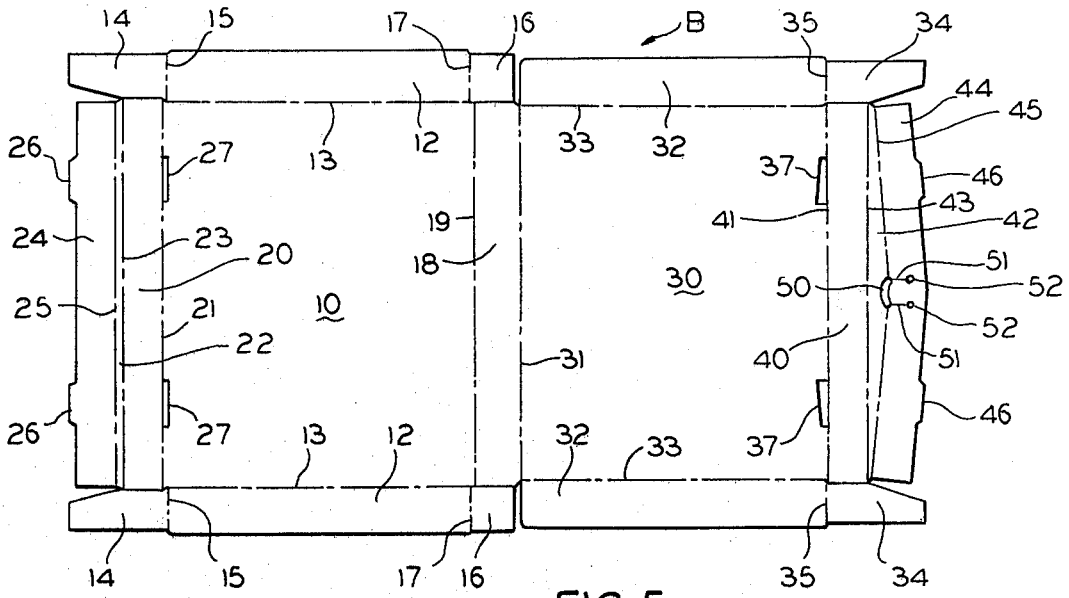
FIG. 5 is a top plan view of a plan of foldable paperboard from which the container illustrated in the other views may be formed.
Figure 1:
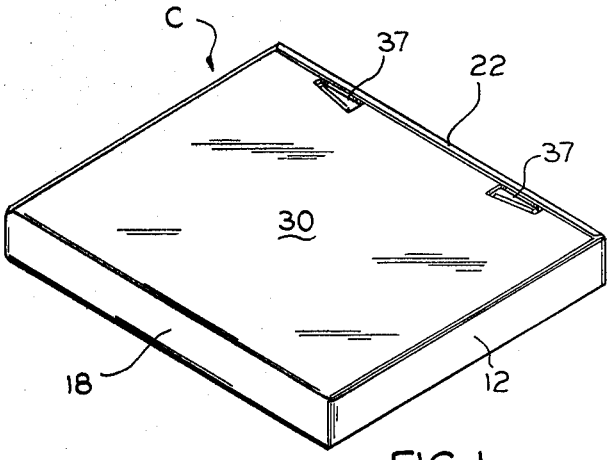
FIG. 1 is a perspective view of a container embodying features of the invention as seen in the erected and closed condition.

Referring now to the drawings for a better understanding of the invention, it will be seen that the novel one piece garment box indicated generally at C in FIG. 1 of the drawings, may be formed from a unitary blank of paperboard indicated generally at B in FIG. 5 of the drawings.

Referring to FIG. 5, it will be noted that the novel container C comprises a pair of generally tray-type sections hingedly interconnected along a common wall and adapted for telescoping engagement one within the other.

The rear or outer section of the container includes a preferably rectangular side wall 10 having a pair of outer end panels 12 foldably joined to opposite side edges thereof along parallel fold lines 13.

Each of the outer end wall panels 12 are provided with a pair of top and bottom corner flaps 14 and 16 which are foldably joined to their top and bottom edges along fold lines 15 and 17 respectively. At its lower edge, side wall 10 is foldably joined along a fold line 19 to one edge of a relatively narrow, elongated common bottom wall 18 which also serves as the bottom wall for the other section, the details of which are described later in the application. At its upper end the outer section is provided with a top wall which includes an upper panel 20, foldably joined to the upper edge of side wall

10 along a fold line 21; a relatively narrow connecting panel 22 foldably joined along one edge on fold line 23 to upper panel 22 and having foldably joined to its other edge along fold line 25 a lower panel 24. At its free edge, lower panel 24 is provided with one or more projections 26 adapted to be received within recesses 27 in side wall 10 to form a Walker lock connection. The other or inner section of the container also includes a similar side wall 30 which is foldably joined to its lower edge along fold line 31 to the common bottom wall 18. Foldably joined to opposite side edges of side wall 30 along fold lines 33 are a pair of inner side wall panels 32, each of which has foldably joined to its upper edge on fold line 35, a corner flap 34.

At its upper end the inner section is also provided with an inner top wall structure which includes an upper panel 40 foldably joined on fold line 41 to the upper edge of side wall 30; a generally triangular connecting panel 42 foldably joined along one edge to the opposite edge of upper panel 40 on fold line 43 and having foldably joined to its opposite edge along diverging fold lines 45 a lower top wall panel 44.

Figure 3:
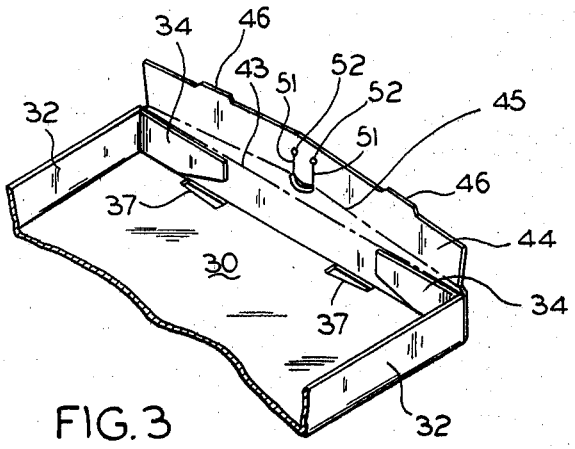
FIG. 3 is a view similar to FIG. 2 but with the container shown in only a partially erected condition to illustrate the manner of forming.
Figure 2:
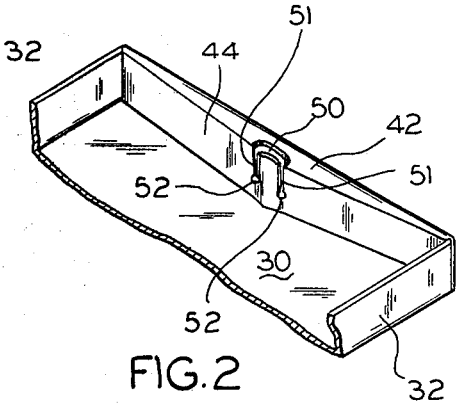
FIG. 2 is a fragmentary, perspective view of one section of the container shown in the erected condition to illustrate the novel top wall structure.
Figure 4:
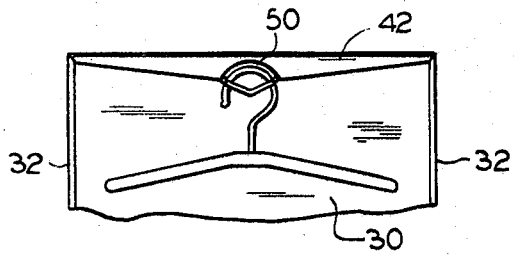
FIG. 4 is a side elevation of the structure illustrated in FIG. 2.

Inner section top wall lower panel 44 is also provided with a pair of projections 46 adapted to be received within recesses 37 in side wall 30. When this inner section top wall is erected, as shown in FIGS. 2 and 3, it will be noted that the structure is hollow, and, because of the general V shape of connecting panel 42, this structure is wider in the middle than at the ends to provide a pocket for receiving one or more hanger hooks. Connecting panel 42 is provided with an opening 50, and inner panel 44 is provided with a pair of slits 51 and tear resistant apertures 52 which afford means for inserting the hanger hooks within the central area of the inner section top wall hollow structure as illustrated in FIG. 4.

Thus it will be seen that there is provided a relatively simple construction which eliminates the need of a conventional hanger bar and permits a hanger to be supported by the top wall of the inner section of the container and wherein the top wall is of such dimension as to accommodate a portion of the hanger hook.

I claim:

1. In a one piece garment container formed from a unitary blank of foldable paperboard including a pair of telescoping sections for holding at least one garment on a hanger having a hook, the combination of:

a. a generally rectangular, relatively narrow common bottom wall;

b. a pair of tray-like sections foldably joined to opposite side edges of said bottom wall and disposed for telescoping relation one within the other, each of said sections including:

i. a side wall;

ii. a pair of opposed end walls;

iii. a top wall;

iv. and said common bottom wall;

c. said side wall of at least one of said sections having a slot formed therein along the top edge thereof;

d. said top wall of at least one of said sections including:

i. a flat upper panel foldably joined at its front edge to the upper edge of said one section side wall;

ii. a relatively narrow, substantially triangularly shaped connecting panel having a straight upper edge foldably joined to one edge of said upper panel and having upwardly diverging lower edges;

iii. a lower panel having its rear edge foldably joined to the lower edges of said connecting panel and having a locking tab projecting outwardly from its front edge, and a pair of parallel slits centrally positioned in said lower panel to receive said hanger hook;

e. said locking tab being received in said slot to secure said top wall in a closed position and support the garment, whereby the crown of said hanger is located below said upper panel.

* * * * *